US006464165B1

(12) United States Patent
Black et al.

(10) Patent No.: US 6,464,165 B1
(45) Date of Patent: Oct. 15, 2002

(54) IMAGE DISPLAY CRAFT

(75) Inventors: Ian Graham Black, Sandton (ZA); Michael Gilbert Booth, 33 Culross Rd., Bryanston, 2021 (ZA)

(73) Assignees: Michael Gilbert Booth (ZA); Future Trading LLC (ZA)

( * ) Notice: Subject to any disclaimer, the term of this patent is extended or adjusted under 35 U.S.C. 154(b) by 0 days.

(21) Appl. No.: 09/701,816

(22) PCT Filed: May 26, 1999

(86) PCT No.: PCT/IB99/00950

§ 371 (c)(1),
(2), (4) Date: Mar. 28, 2001

(87) PCT Pub. No.: WO99/63511

PCT Pub. Date: Dec. 9, 1999

(30) Foreign Application Priority Data

Jun. 4, 1998 (ZA) ..... 98/4828

(51) Int. Cl.[7] ..... G09F 21/10

(52) U.S. Cl. ..... 244/1 R; 24/30; 24/118.1; 40/212; 353/13

(58) Field of Search ..... 244/118.1, 1 R, 244/30; 40/212–215; 353/11–12, 13, 14, 28, 62, 79, 80, 74; 350/125; 359/443, 461

(56) References Cited

U.S. PATENT DOCUMENTS

| | | | | | |
|---|---|---|---|---|---|
| 1,709,620 | A | * | 4/1929 | Junkers | 353/13 |
| 1,765,665 | A | * | 6/1930 | Frider | 40/212 |
| 2,066,158 | A | * | 12/1936 | Patterson | 353/13 |
| 3,475,045 | A | * | 10/1969 | Cordes | 353/13 |
| 4,236,333 | A | * | 12/1980 | Kohm et al. | 40/212 |
| 4,597,633 | A | * | 7/1986 | Fussell | 40/212 |
| 5,580,140 | A | * | 12/1996 | Katz et al. | 353/13 |

FOREIGN PATENT DOCUMENTS

| | | |
|---|---|---|
| DE | 623053 | 12/1935 |
| DE | 2309904 | 8/1974 |
| DE | 3327944 | 2/1985 |
| FR | 603664 | 4/1926 |

* cited by examiner

*Primary Examiner*—Galen L. Barefoot
(74) *Attorney, Agent, or Firm*—Piper Rudnick; Michael L. Kenaga

(57) ABSTRACT

An image display craft (10) for outdoor advertising. The craft is lighter than air, such as a dirigible airship (12), and has flat projection surfaces (16) on each of its sides. Variable static or moving images, such as advertising images or other messages, are projected onto the sides of the craft by projectors (30) which are positioned on booms (22) that extend laterally from the craft. As the airship moves around the sky the image is visible on the exterior of the craft to observers on the ground.

4 Claims, 1 Drawing Sheet

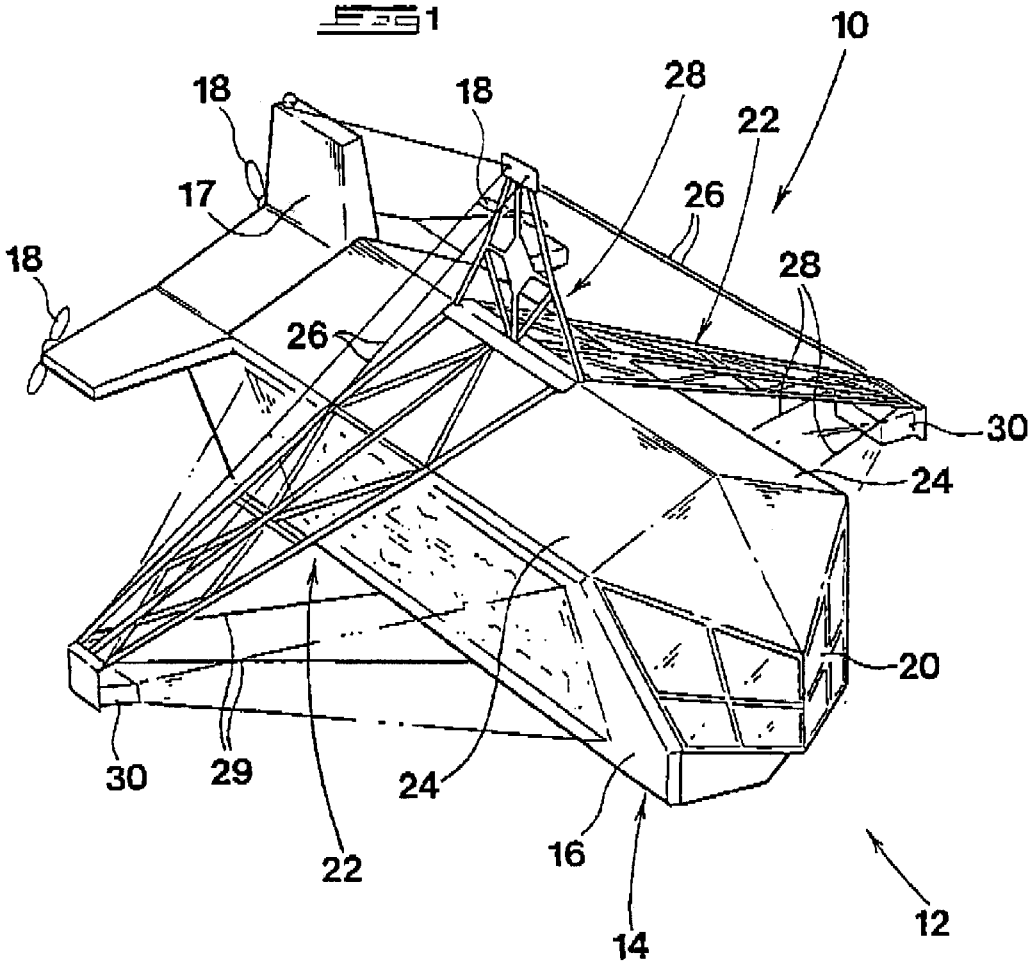
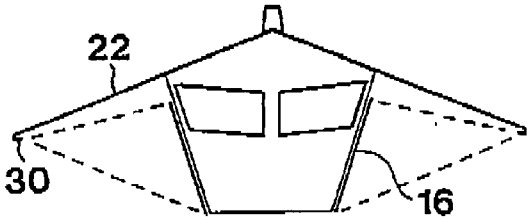
2
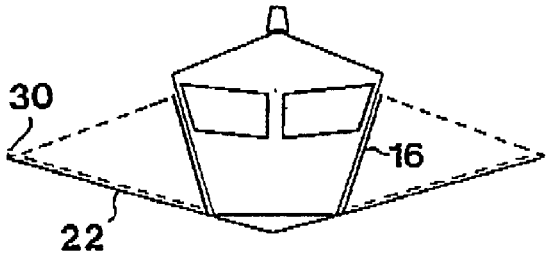
3
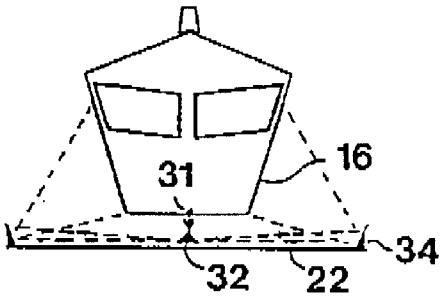
4

IMAGE DISPLAY CRAFT

BACKGROUND TO THE INVENTION

THIS invention relates to an image display craft.

Advertisers are constantly looking for new ways to get advertising messages to members of the public. The present invention seeks to provide an image display craft which can, inter alia, be used to convey visible advertising messages to the public.

SUMMARY OF THE INVENTION

According to the invention there is provided a lighter-than-air image display craft carrying a projection surface and image projection means which is operable to project an image, which will be visible from the exterior of the craft, onto the projection surface.

Typically, the image projection means is operable to project an externally visible, variable image onto the projection surface.

Many different possibilities are within the scope of the invention. For instance, there may be a projection surface at at least one side of the craft and support means extending laterally from the craft to a position laterally beyond the projection surface, the image projection means comprising an image projector supported by the support means and operable to project an externally visible image back onto the projection surface. This arrangement can be duplicated on both sides of the craft.

According to another possibility, there are projection surfaces on opposite sides of the craft and support means extending laterally to both sides of the craft to positions laterally beyond the respective projection surfaces, the image projection means comprising outer reflector means supported by the support means, a central image projector and central reflector means arranged to reflect images projected onto it by the projector outwardly onto the outer reflector means which are in turn arranged to reflect the images onto the respective projection surfaces.

According to yet another possibility the image projection means comprises an image projector located inwardly of the projection surface and arranged to project an image outwardly onto the projection surface which will be visible from the exterior of the craft.

BRIEF DESCRIPTION OF THE DRAWINGS

The invention will now be described in more detail, by way of example only, with reference to the accompanying drawings in which:

FIG. 1 illustrates an image display craft according to the invention;

FIG. 2 shows a diagrammatic front view of the invention illustrated in FIG. 1; and FIGS. 3 to 4 show diagrammatic front views of the image display craft, illustrating alternative boom and image projection arrangements.

DESCRIPTION OF THE ILLUSTRATED EMBODIMENTS

FIG. 1 shows a lighter-than-air image display craft 10, in this case a dirigible airship. As in the case of conventional airships, the airship 12 accommodates a large volume of a suitable lighter-than-air gas, typically helium, which renders the airship buoyant in air. In the illustrated case, the container for the helium or other gas is a multi-faceted container

14 with a suitable internal supporting framework if necessary. It will be noted that the container 14 includes large, flat panels 16 (only one visible) on opposite sides thereof. As described below the outer surfaces of the panels 16 serve as image projection surfaces.

In addition to the gas container, the airship 12 includes one or more motors located in a housing 17 and driving rear-mounted propellers 18 which are used both to propel the airship and steer it. The airship is piloted from a control cabin 20 located at the front end of the airship.

Booms 22 are connected to upper panels 24 of the container 14 and project laterally to opposite sides thereof. Additional rigidifying support for the booms is provided by wire stays 26 extending between an upstanding stanchion 28 on the container and the booms and wire stays 29 extending between the underside of the container and the booms.

Referring to FIGS. 1 and 2, the booms 22 carry projectors, at their ends, indicated by the reference numeral 30. The projectors may, for instance, be cine or video projectors which can be controlled remotely from the control cabin 20. Alternatively the projectors may be ultra high brightness LCD light-valve projectors of the type manufactured by BARCO under the product description "BARCOVISION 9200".

The projectors are aimed at the panels 16 and can be operated to project light images, which will be visible to an external observer, back onto those panels. The images may, for instance, be static or moving advertising images and/or other images or messages. It is envisaged that the projected images will be large enough to be clearly visible, especially at night time, to observers on the ground when the airship 12 is flying slowly at a suitable altitude, thereby conveying a powerful and effective means of outdoor advertising or displaying other messages.

Many variations are possible within the scope of the invention. For instance, the gas container of the airship could have a conventional cigar of other shape with the required projection surfaces being provided by separate panels fixed to opposite sides of the container. The projection surfaces need not be flat. In instances when the surfaces are curved, suitable optical correction apparatus can be provided to ensure that observers see an optically correct image. In addition, the booms that support the image projection apparatus may be mounted at locations other than that described above.

FIG. 3 shows an alternative mounting arrangement of the booms at the underside of the craft. The projectors 30 are carried at the ends of the booms 22 to project images onto the panels 16.

FIG. 4 shows another arrangement with booms 22 mounted under the craft to facilitate the use of a single projector 31 which is mounted on the under side of the airship. The projected image is directed onto a double reflector 32, such as a split mirror, to direct distinct parts of the image onto mirrors 34 located on the booms which in turn reflect the separate images onto the projection surfaces. The path of the image is indicated in FIG. 4 by means of arrows. In this embodiment the booms need not project as far from the craft as in other embodiments, as mirrors 34 may be located more closely to the projection surfaces.

The lighter-than-air craft need not necessarily be a dirigible airship and could, instead, be a static blimp which is anchored to the ground. Although the embodiments illustrated in FIGS. 1 to 3 include two projectors and two projection surfaces, it is within the scope of the invention for there to be a single projector and single projection surface, possible at the underside, front or rear of the craft.

It is also within the scope of the invention for suitable projection apparatus to be located inwardly of the projection surface(s), possibly housed within the container 14 itself, and to project light images outwardly onto one or more surfaces of the craft which are made of a material of appropriate translucency to arrest the light in such a manner as to be visible on those surfaces to external observers.

What is claimed is:

1. A lighter-than-air image display craft, the craft having opposite sides, the craft comprising:

projection surfaces on opposite sides of the craft;

support means extending laterally to the opposite sides of the craft to positions laterally beyond the respective projection surfaces; and an image projection means that includes outer reflector means supported by the support means, a central image projector and a central reflector means arranged to reflect images projected onto the central reflector means by the projector outwardly onto the outer reflector means, the outer reflector means are arranged to reflect the images onto the respective projection surfaces.

2. A lighter-than-air image display craft according to claim 1 wherein the image projection means is operable to project an externally visible, variable image onto the projection surface.

3. A lighter-than-air image display craft according to claim 1 wherein each projection surface is flat.

4. A lighter-than-air image display craft according to claim 1 wherein the craft is a self-propelled, dirigible airship.

* * * * *